US009193568B2

(12) United States Patent
Inoue

(10) Patent No.: US 9,193,568 B2
(45) Date of Patent: Nov. 24, 2015

(54) PASSENGER CONVEYOR

(75) Inventor: Akihiko Inoue, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/363,930

(22) PCT Filed: Jan. 6, 2012

(86) PCT No.: PCT/JP2012/050181

§ 371 (c)(1),
(2), (4) Date: Jun. 9, 2014

(87) PCT Pub. No.: WO2013/103016

PCT Pub. Date: Jul. 11, 2013

(65) Prior Publication Data

US 2014/0326577 A1 Nov. 6, 2014

(51) Int. Cl.

| | |
|---|---|
| ***B66B 21/02*** | (2006.01) |
| ***B66B 23/14*** | (2006.01) |
| ***B66B 23/22*** | (2006.01) |
| ***B66B 23/00*** | (2006.01) |
| ***B66B 23/12*** | (2006.01) |

(52) U.S. Cl.

CPC ..... *B66B 21/02* (2013.01); *B66B 23/00* (2013.01); *B66B 23/12* (2013.01); *B66B 23/14* (2013.01); *B66B 23/22* (2013.01)

(58) Field of Classification Search

CPC .... B66B 23/00; B66B 23/14; B66B 11/0226; B66B 21/02

USPC ..... 198/321, 326

See application file for complete search history.

(56) References Cited

U.S. PATENT DOCUMENTS

| | | | | | |
|---|---|---|---|---|---|
| 4,064,986 | A | * | 12/1977 | Bertovich | 198/326 |
| 4,235,326 | A | * | 11/1980 | Nakao et al. | 198/326 |
| 4,819,781 | A | | 4/1989 | Saito et al. | |
| 5,325,955 | A | * | 7/1994 | Ahls et al. | 198/332 |

(Continued)

FOREIGN PATENT DOCUMENTS

| | | | |
|---|---|---|---|
| JP | 3-9377 | U | 1/1991 |
| JP | 2003-201083 | A | 7/2003 |

(Continued)

OTHER PUBLICATIONS

Office Action issued Oct. 28, 2014 in Japanese Patent Application No. 2013-552378 (with English language translation).

(Continued)

*Primary Examiner* — James R Bidwell

(74) *Attorney, Agent, or Firm* — Oblon, McClelland, Maier & Neustadt, L.L.P.

(57) ABSTRACT

Provided is a passenger conveyor apparatus that can be reduced in number of components. The passenger conveyor apparatus includes a plurality of footsteps to be moved in a circulating manner, a moving handrail to be moved in a circulating manner in synchronization with the movement of the plurality of footsteps, and a truss for supporting the plurality of footsteps and the moving handrail. A skirt guard is provided on a lateral side of the plurality of footsteps. At least one roller is provided to each of the plurality of footsteps. The roller is guided by a rail corresponding to the roller. The rail is fixed to a rail supporting plate supported on the truss. At least one of the skirt guard and the moving handrail is fixed to the rail supporting plate.

5 Claims, 5 Drawing Sheets

(56) References Cited

U.S. PATENT DOCUMENTS

| | | | | |
|---|---|---|---|---|
| 5,601,179 | A | 2/1997 | Wente et al. | |
| 6,527,103 | B2 | 3/2003 | Neszmerak | |
| 2007/0029161 | A1* | 2/2007 | Streibig et al. | 198/326 |
| 2012/0073934 | A1* | 3/2012 | Heinemann et al. | 198/326 |

FOREIGN PATENT DOCUMENTS

| | | | |
|---|---|---|---|
| JP | 2007-161452 | | 6/2007 |
| JP | 2007-230673 | | 9/2007 |
| JP | 2011-16605 | A | 1/2011 |
| JP | 2011-26083 | | 2/2011 |

OTHER PUBLICATIONS

International Search Report issued Jul. 17, 2012, in PCT/JP2012/050181, filed Jan. 6, 2012.

Office Action issued Feb. 10, 2015 in Chinese Patent Application No. 201280062904.6 (with English language translation).

* cited by examiner

PASSENGER CONVEYOR

TECHNICAL FIELD

The present invention relates to a passenger conveyor apparatus.

BACKGROUND ART

As is described in Patent Literature 1 as an example, a passenger conveyor apparatus such as an escalator includes a plurality of footsteps on which a user stands, and the respective footsteps include a plurality of rollers provided as a driving roller and a driven roller. Further, the passenger conveyor apparatus includes a plurality of rails for guiding and supporting the rollers. In addition, the passenger conveyor apparatus includes moving handrails to be moved in a circulating manner, on which the user rests his/her hand. Portions of the moving handrails on a return path side are supported by handrail supporting members at positions inside skirt guards.

In the related-art passenger conveyor apparatus, however, the plurality of rails, the skirt guards, and the handrail supporting members are supported on vertical members of a truss through an intermediation of individual dedicated brackets, respectively. Therefore, a large number of dedicated brackets are used, which leads to a problem in that the number of components is increased significantly.

CITATION LIST

Patent Literature

[PTL 1] JP 2003-201083 A

SUMMARY OF INVENTION

Technical Problem

The present invention has been made in view of the above-mentioned circumstances, and it is therefore an object thereof to provide a passenger conveyor apparatus that can be reduced in number of components.

Solution to Problem

In order to achieve the above-mentioned object, according to one embodiment of the present invention, there is provided a passenger conveyor apparatus, including: a plurality of footsteps to be moved in a circulating manner; a moving handrail to be moved in a circulating manner in synchronization with the movement of the plurality of footsteps; a truss for supporting the plurality of footsteps and the moving handrail; a skirt guard provided on a lateral side of the plurality of footsteps; at least one roller provided to each of the plurality of footsteps; a rail corresponding to the at least one roller, for guiding the at least one roller; and a rail supporting plate supported on the truss, the rail supporting plate having the rail fixed thereto, at least one of the skirt guard and the moving handrail being fixed to the rail supporting plate.

Advantageous Effects of Invention

The passenger conveyor apparatus according to one embodiment of the present invention can be reduced in number of components for supporting the skirt guard or the moving handrail.

DESCRIPTION OF EMBODIMENT

Figure 1:
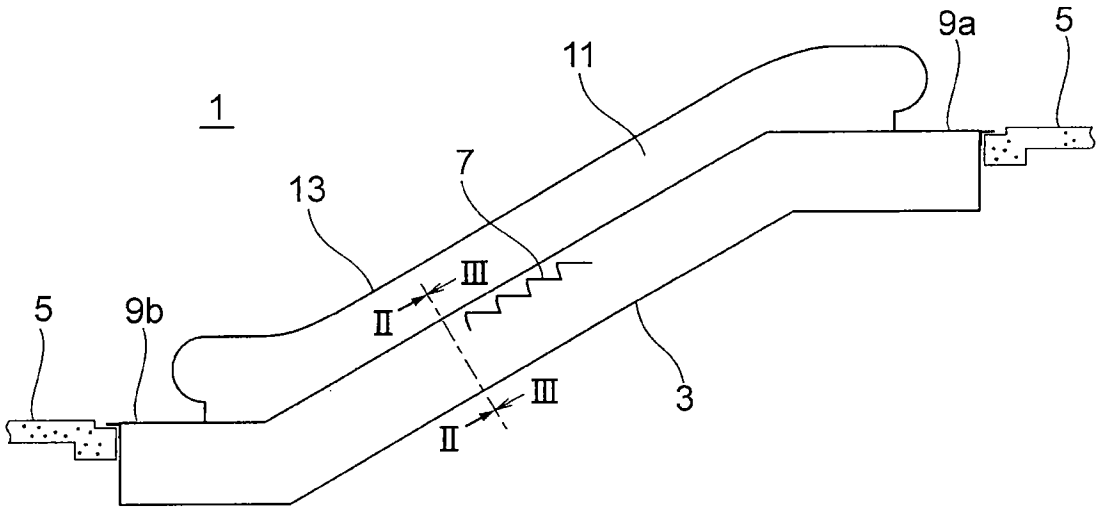
FIG. 1 is a side view illustrating an entire escalator apparatus according to an embodiment of the present invention.

Now, referring to the accompanying drawings, description is given of a passenger conveyor apparatus applied as an escalator apparatus according to an embodiment of the present invention. Note that, in the drawings, the same reference symbols represent the same or corresponding parts.

Figure 2:
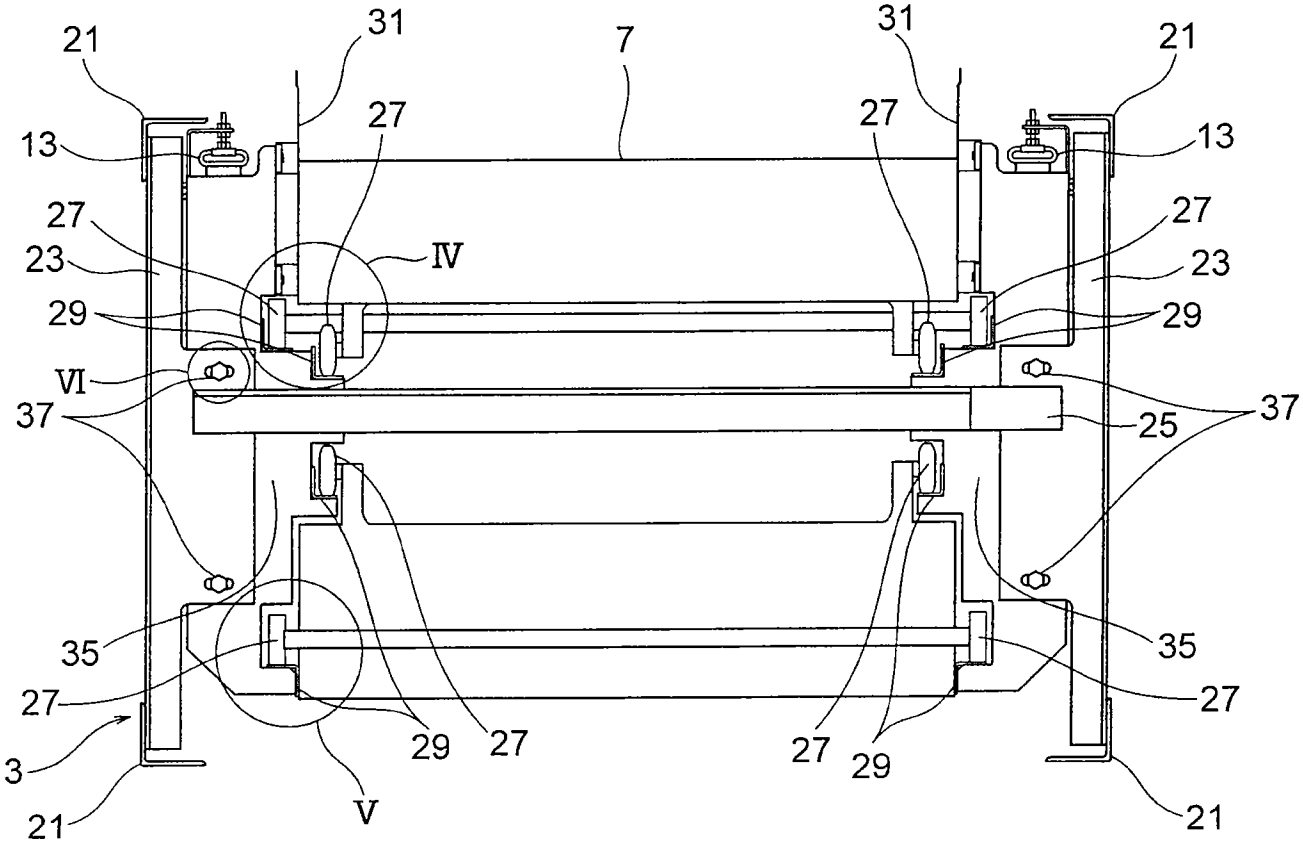
FIG. 2 is a view illustrating a rail supporting structure as seen from the bottom side along the line II-II of FIG. 1.
Figure 3:
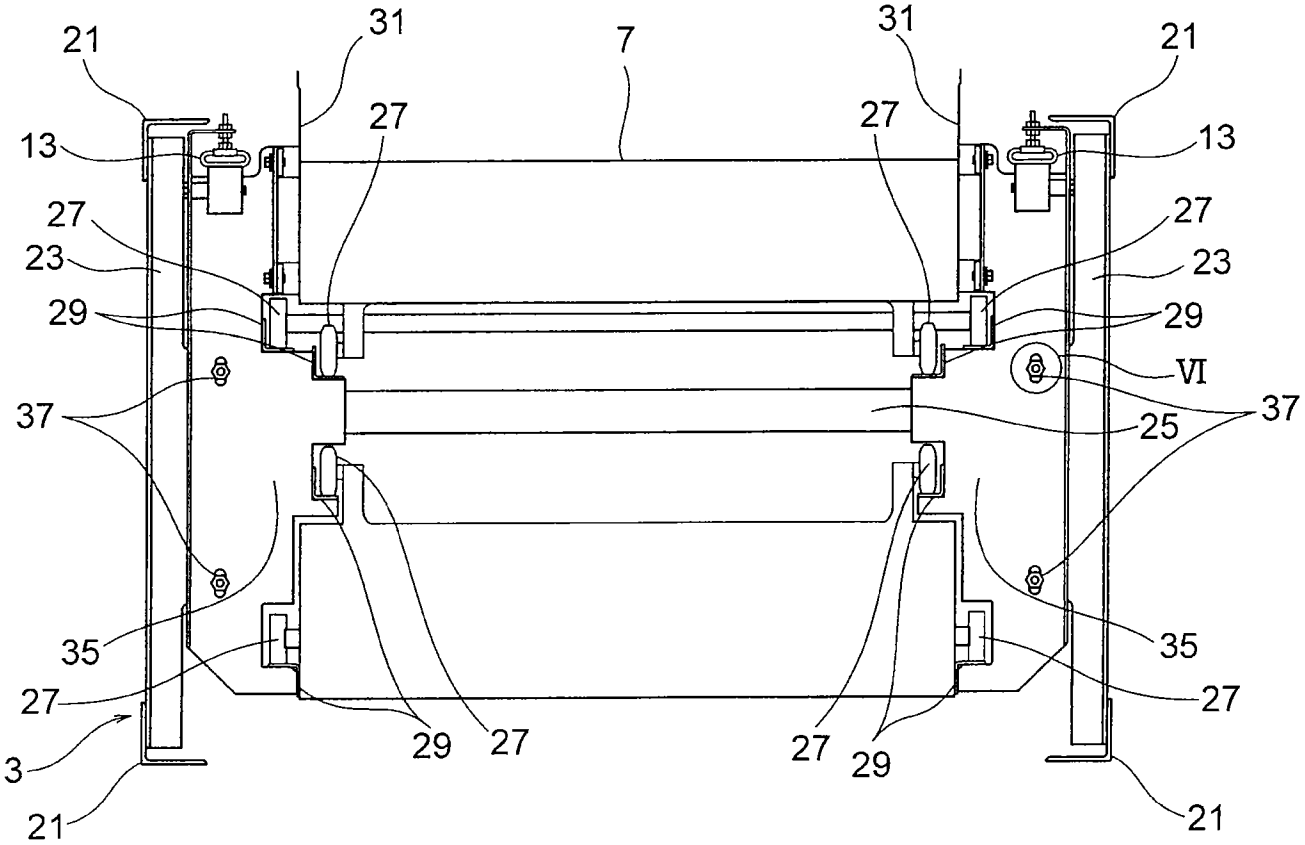
FIG. 3 is a view illustrating the rail supporting structure as seen from the top side along the line III-III of FIG. 1.
Figure 4:
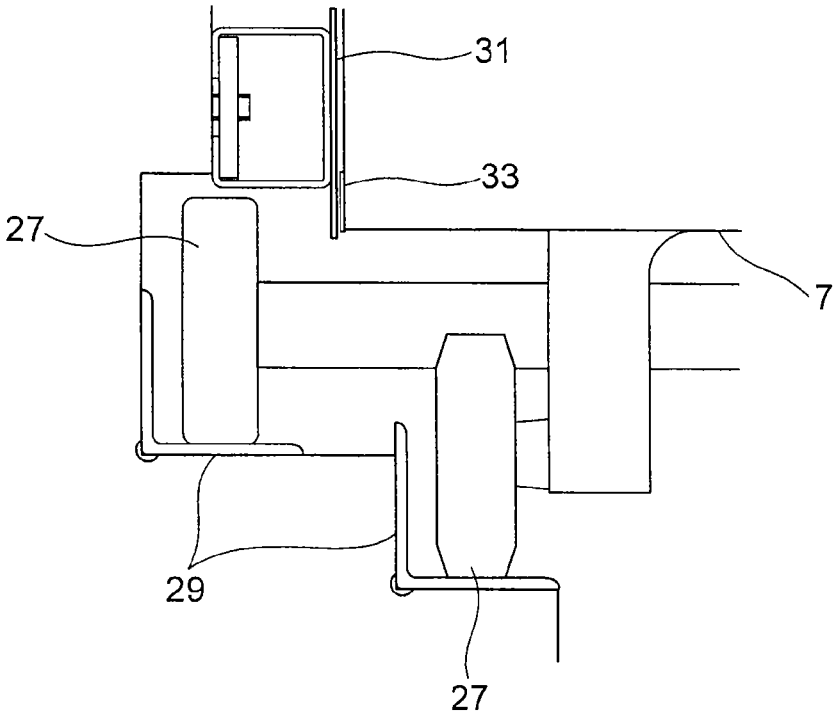
FIG. 4 is an enlarged view illustrating the portion IV of FIG. 2.
Figure 5:
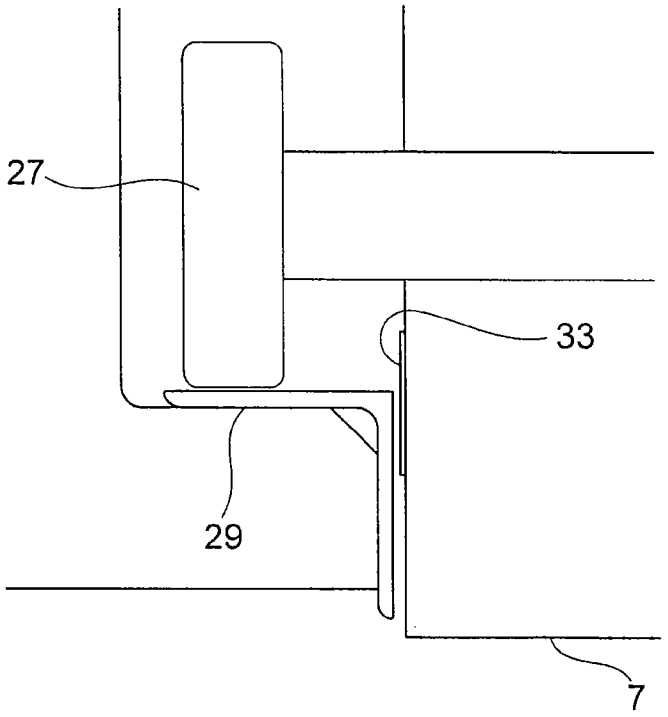
FIG. 5 is an enlarged view illustrating the portion V of FIG. 2.

FIG. 1 is a side view illustrating the entire escalator apparatus according to this embodiment. Further, FIG. 2 is a view illustrating a rail supporting structure as seen from the bottom side along the line II-II of FIG. 1, and FIG. 3 is a view illustrating the rail supporting structure as seen from the top side along the line III-III of FIG. 1. FIGS. 4 and 5 are enlarged views illustrating the portions IV and V of FIG. 2, respectively.

An escalator 1 includes a truss 3 extending obliquely in an up-and-down direction. The truss 3 is supported at its upper and lower end portions by beams 5 of a building structure. A plurality of footsteps 7 coupled together into an endless shape are provided to the truss 3 as a passenger conveying unit. The plurality of footsteps 7 are moved in a circulating manner between an upper landing **9*a* and a lower landing 9*b* due to a driving force of a well-known driver (not shown) provided inside the truss 3**.

Balustrades 11 are provided upright on both right and left sides of the footsteps 7. The balustrades 11 extend along a longitudinal direction of the truss 3, and are supported on an upper portion of the truss 3. Further, moving handrails 13 configured to move in synchronization with the movement of the footsteps 7 are provided to the respective balustrades 11. The moving handrails 13 are belt-like members formed into an endless shape, and are provided so as to move in a circulating manner around outer peripheries of the respective balustrades 11 on their front, rear, upper, and lower sides.

Referring to FIGS. 2 to 5, description is given of an overview of a structure for supporting rails that guide rollers of the footsteps. Note that, the structure for supporting rails according to this embodiment is, for example, constructed in a vertically symmetrical manner. The truss 3 includes a plurality of main frames 21, a plurality of vertical members 23, and a plurality of horizontal members 25. Each of the vertical members 23 is provided so as to extend between the upper main frame 21 and the lower main frame 21. Further, the right and left vertical members 23 are connected to each other through the corresponding horizontal member 25.

A plurality of rollers 27 serving as a known driving roller and driven roller are provided at both right and left side portions of the plurality of footsteps 7. The rollers 27 are supported by corresponding rails 29, and the movement of the rollers 27 is guided by the rails 29.

Skirt guards 31 are provided on both right and left sides of the plurality of footsteps 7. Further, as illustrated in FIGS. 4 and 5, guide pads 33 are fixed to the side portions of the footsteps 7. Each of the guide pads 33 is positioned between the skirt guard 31 and the footstep 7 as illustrated in a state of an advance path side (side that is used by a user) in FIG. 4. The guide pad 33 abuts against the skirt guard 31, and hence an excessive movement (undesired excessive movement) of the footstep 7 in a width direction (in a right-and-left direction of the drawing sheets of FIGS. 2 to 5) is restricted. Note that, on a return path side (side that is not used by the user) of the footstep 7, the guide pad 33 abuts against the rail 29 as illustrated in FIG. 5, and hence the excessive movement of the footstep 7 in the width direction is also restricted on the return path side. Thus, in this embodiment, the excessive movements of the footsteps 7 in the width direction are restricted over the entire escalator 1.

Rail supporting plates 35 are fixed to the respective vertical members 23 of the truss 3. In this embodiment, the rail supporting plates 35 are fixed to the respective vertical members 23 with fastening members 37 such as bolts.

The above-mentioned rail 29 is fixed to each rail supporting plate 35. At least one of the skirt guard 31 and the moving handrail 13 is further fixed to the rail supporting plate 35. In this embodiment, both of the skirt guard 31 and the moving handrail 13 are fixed to the rail supporting plate 35. That is, in this embodiment, three types of components, specifically, the rail 29, the skirt guard 31, and the moving handrail 13 are fixed to the rail supporting plate 35 as a common fixing target.

Figure 6:
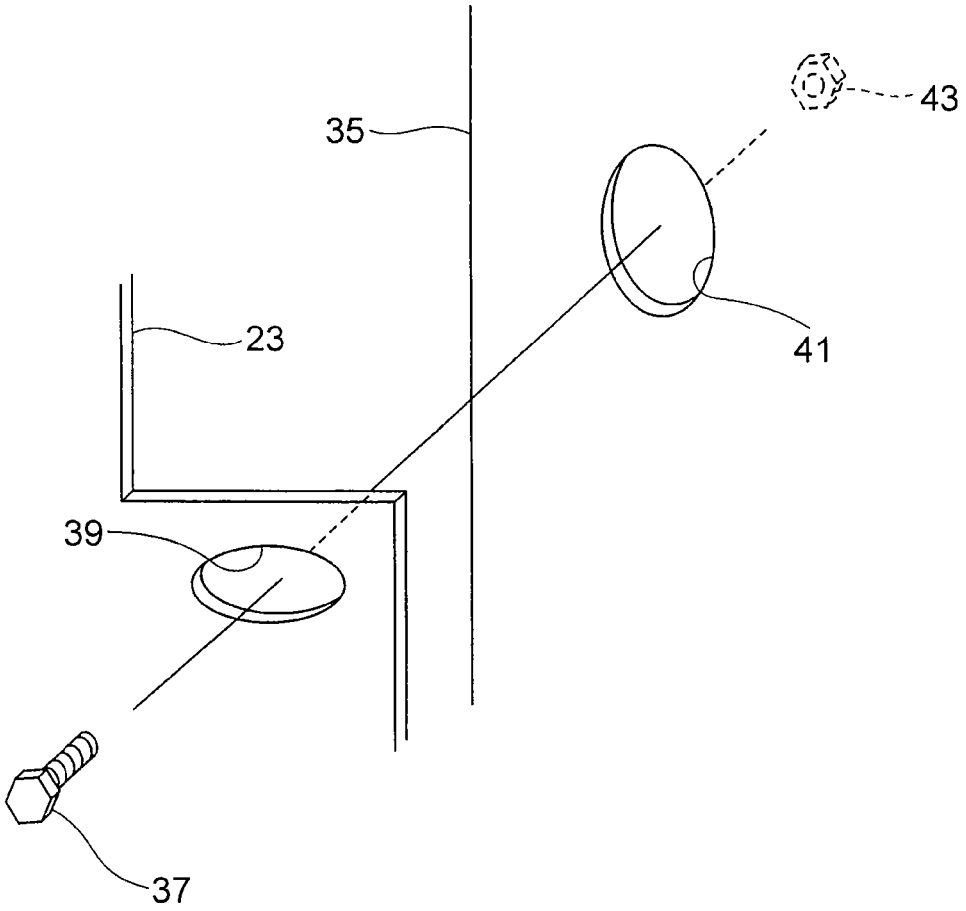
FIG. 6 is an exploded perspective view illustrating the portion VI of FIGS. 2 and 3.

Further, detailed description is given of a manner of fixing the rail supporting plate 35 to the vertical member 23. FIG. 6 is an exploded perspective view illustrating the portion VI of FIGS. 2 and 3, and FIG. 7 is a projection view illustrating a relationship between an elongated hole of the rail supporting plate and an elongated hole of the vertical member.

As illustrated in FIG. 6, elongated holes 39 and 41 are formed in the vertical member 23 and the rail supporting plate 35, respectively. The above-mentioned fastening member 37 is arranged so as to pass through the elongated holes 39 and 41, and a securing member 43 such as a nut is connected to a distal end of the fastening member 37. In this manner, the rail supporting plate 35 and the vertical member 23 are coupled to each other.

Figure 7:
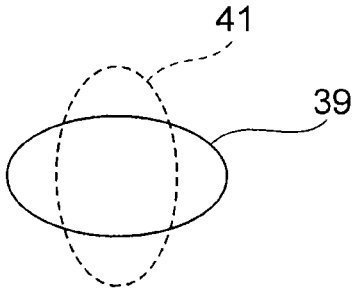
FIG. 7 is a projection view illustrating a relationship between an elongated hole of a rail supporting plate and an elongated hole of a vertical member.

Further, as illustrated in FIG. 7, the extending direction of the elongated hole 39 of the vertical member 23 and the extending direction of the elongated hole 41 of the rail supporting plate 35 are different from each other in projection view of the elongated holes 39 and 41 as seen in a hole forming direction at the time when the vertical member 23 and the rail supporting plate 35 are coupled to each other. As a specific example of this embodiment, the extending direction of the elongated hole 39 of the vertical member 23 and the extending direction of the elongated hole 41 of the rail supporting plate 35 are different so as to cross each other in projection view of the elongated holes 39 and 41 as seen in the hole forming direction. For example, the extending directions have an orthogonal relationship.

In the escalator constructed as described above, at least one of the rail, the skirt guard, and the moving handrail is supported by the same component, and hence the number of components can be reduced. That is, when the rail and the skirt guard are supported by the rail supporting plate, the bracket for fixing the skirt guard, which is necessary in the related art, can be eliminated. When the rail and the moving handrail are supported by the rail supporting plate, the bracket for fixing the moving handrail, which is necessary in the related art, can be eliminated. In any case, the number of components can be reduced.

Further, when the three types of components, specifically, the rail, the skirt guard, and the moving handrail are fixed to the rail supporting plate, the number of components can be reduced more significantly than in the manner of supporting the respective components on the truss with the individual dedicated members. Both of the bracket for fixing the skirt guard and the bracket for fixing the moving handrail, which are necessary in the related art, can be eliminated.

In addition, when the three types of components, specifically, the rail, the skirt guard, and the moving handrail are fixed to the rail supporting plate, the three types of components are supported by the same component. Therefore, when the position of the rail supporting plate is aligned, the positions of the rail, the skirt guard, and the moving handrail can also be aligned at the same time. Thus, the working time can be reduced significantly in the factory and/or worksite.

That is, in the related-art passenger conveyor apparatus, the plurality of rails, the skirt guards, and the handrail supporting members are supported on the vertical members of the truss, individually. Therefore, according to the related-art, in the worksite where the passenger conveyor apparatus is to be installed, the arrangement positions of the plurality of rails, the skirt guards, and the handrail supporting members need to be aligned, individually, which leads to a problem in that the arrangement work becomes complicated. To address this problem, according to this embodiment, the positions of the rail, the skirt guard, and the moving handrail can be aligned at the same time as described above, and hence the complication of the work can be suppressed.

In addition, in the related-art passenger conveyor apparatus, the restriction of the plurality of footsteps in the width direction is achieved by restricting the plurality of rollers, which are provided on the right and left sides of the footsteps, with the corresponding rails. Therefore, according to the related-art, after the positions of rails are aligned, the positions of the skirt guards in the width direction are also aligned while confirming the clearance between the footsteps and the skirt guards, which requires a long working time. In contrast, in this embodiment, when the position of the rail supporting plate is aligned, the positions of the footsteps and the skirt guards can be aligned at the same time. Further, when the guide pads provided on the side surfaces of the positionally aligned footsteps abut against the positionally aligned skirt guards, the excessive movements of the footsteps in the width direction can be restricted. Thus, the work of restricting the footsteps in the width direction can be completed easily and quickly.

Besides, in this embodiment, the truss and the rail supporting plate are coupled to each other by the fastening member that passes through the elongated hole of the truss and the elongated hole of the rail supporting plate. Therefore, in the worksite where the passenger conveyor apparatus is to be installed, the fixing positions of the rail, the skirt guard, and the moving handrail can be adjusted finely depending on the building for which the passenger conveyor apparatus is to be installed. When the extending direction of the elongated hole of the truss and the extending direction of the elongated hole of the rail supporting plate are caused to differ from each other, there is attained an advantage in that the fine adjustment can be carried out for a wide range of directions. Moreover, this advantage can be attained only by such a simple configuration that the elongated hole and the elongated hole are overlapped with each other.

The details of the present invention have been described above specifically with reference to the preferred embodiment, but it is apparent that a person skilled in the art may employ various modifications based on the basic technical thoughts and teachings of the present invention.

The present invention is applied to the passenger conveyor for conveying the user to a desired place through the movement of the conveying unit on which the user stands, and the present invention is not limited to the escalator. Thus, to take another example, the present invention is also applicable to a moving walkway.

In addition, the manner of fixing the rail supporting plate to the vertical member is not limited to the use of the fastening member, and may be, for example, welding.

REFERENCE SIGNS LIST

1 escalator (passenger conveyor apparatus), 3 truss, 7 footstep, 13 moving handrail, 27 roller, 29 rail, 31 skirt guard, 33 guide pad, 35 rail supporting plate, 37 fastening member, 39, 41 elongated hole

The invention claimed is:

1. A passenger conveyor apparatus, comprising:

a plurality of footsteps to be moved in a circulating manner;

a moving handrail to be moved in a circulating manner in synchronization with the movement of the plurality of footsteps;

a truss for supporting the plurality of footsteps and the moving handrail;

a skirt guard provided on a lateral side of the plurality of footsteps;

at least one roller provided to each of the plurality of footsteps;

a rail corresponding to the at least one roller, for guiding the at least one roller; and a rail supporting plate supported on the truss, the rail supporting plate having the rail fixed thereto, the skirt guard and the moving handrail being fixed directly to the rail supporting plate.

2. A passenger conveyor apparatus according to claim 1, wherein the rail, the skirt guard, and the moving handrail are fixed to the rail supporting plate supported on the truss.

3. A passenger conveyor apparatus according to claim 2, wherein the each of the plurality of footsteps comprises a guide pad fixed to a side portion thereof, and wherein the guide pad is configured to abut against the skirt guard so as to restrict an excessive movement of the each of the plurality of footsteps in a width direction thereof.

4. A passenger conveyor apparatus, comprising:

a plurality of footsteps to be moved in a circulating manner;

a moving handrail to be moved in a circulating manner in synchronization with the movement of the plurality of footsteps;

a truss for supporting the plurality of footsteps and the moving handrail;

a skirt guard provided on a lateral side of the plurality of footsteps;

at least one roller provided to each of the plurality of footsteps;

a rail corresponding to the at least one roller, for guiding the at least one roller; and a rail supporting plate supported on the truss, the rail supporting plate having the rail fixed thereto, at least one of the skirt guard and the moving handrail being fixed to the rail supporting plate, wherein the truss has an elongated hole formed therein, wherein the rail supporting plate has an elongated hole formed therein, wherein the truss and the rail supporting plate are coupled to each other by a fastening member that passes through the elongated hole of the truss and the elongated hole of the rail supporting plate, and wherein an extending direction of the elongated hole of the truss and an extending direction of the elongated hole of the rail supporting plate are different from each other as seen in a hole forming direction.

5. A passenger conveyor apparatus, comprising:

a plurality of footsteps to be moved in a circulating manner;

a moving handrail to be moved in a circulating manner in synchronization with the movement of the plurality of footsteps;

a truss for supporting the plurality of footsteps and the moving handrail;

a skirt guard provided on a lateral side of the plurality of footsteps;

at least one roller provided to each of the plurality of footsteps;

a rail corresponding to the at least one roller, for guiding the at least one roller; and a rail supporting plate supported on the truss, the rail supporting plate having the rail mounted directly thereto, at least one of the skirt guard and the moving handrail being mounted directly to the rail supporting plate, wherein the rail, the skirt guard, and the moving handrail are mounted directly to the rail supporting plate supported on the truss.

* * * * *